United States Patent [19]

Brouthers

[11] 4,015,354

[45] Apr. 5, 1977

[54] GUN SIGHT

[75] Inventor: Paul E. Brouthers, Monson, Mass.

[73] Assignee: Dan Wesson Arms, Inc., Monson, Mass.

[22] Filed: Mar. 29, 1976

[21] Appl. No.: 671,355

[52] U.S. Cl. ..... 42/1 S; 33/233; 33/243

[51] Int. Cl.[2] ..... F41G 1/02

[58] Field of Search ..... 42/1 S; 33/233, 241, 33/242, 243, 252

[56] References Cited

UNITED STATES PATENTS

| | | | |
|---|---|---|---|
| 1,033,495 | 7/1912 | Tufts | 33/233 |
| 2,010,893 | 8/1935 | Redfield | 33/243 |
| 2,030,312 | 2/1936 | Mossberg | 42/1 S |
| 2,788,600 | 4/1957 | Pokorny | 42/1 S |

*Primary Examiner*—Charles T. Jordan
*Attorney, Agent, or Firm*—Wolf, Greenfield & Sacks

[57] ABSTRACT

A front gun sight for a firearm that is readily removable and yet easily locked in position. The sight comprises a top exposed section having an insert of contrasting color and a lower section received in a slot in the outer surface of the barrel or shroud. The lower section has a dovetail configuration that locks against a rod or bar extending across the slot and further receives a locking screw passing through the barrel or shroud and engaging the dovetail from a direction orthogonal to the rod.

9 Claims, 4 Drawing Figures

GUN SIGHT

BACKGROUND OF THE INVENTION

The present invention relates in general to gun sights and is concerned more particularly, with an improved construction of a gun sight for use on a firearm and preferably a revolver.

By way of prior art examples of gun sight constructions, see U.S. Pat. Nos. 2,010,893; 793,016; 453,828; 1,365,236; 906,943; 2,610,406; and 2,842,848. There are some inherent drawbacks or disadvantages associated with these prior art structures. For example, the sight may be supported by a relatively small base such as is shown in U.S. Pat. No. 793,016 thereby making the sight more susceptible to shock when the firearm is fired. This is expecially important when the gun sight has a different colored insert as the shock has a tendency to displace this insert.

Accordingly, one object of the present invention is to provide an improved interlocking arrangement for the gun sight to the muzzle end of the barrel which minimizes the effect of shock and vibration to the gun sight.

Another object of the present invention is to provide an improved interlocking arrangement for a gun sight which provides superior retention of the gun sight in the muzzle end of the barrel and prevents transverse displacement of an insert material in the gun sight which may be occasioned by shock or vibration encountered during use and especially on a magnum pistol or revolver.

A further object of the present invention is to provide an improved gun sight that may be easily removed and is yet quickly locked in position. In accordance with the invention if one desires to replace a gun sight or use a different type of a gun sight the operation can be conducted quite quickly with the gun sight being maintained in a secure locked position when in place.

SUMMARY OF THE INVENTION

To accomplish the foregoing and other objects of this invention there is provided a gun sight which is for attachment to the muzzle end of the barrel of a firearm. The gun sight of this invention is particularly useful for a pistol or revolver. The gun sight has an exposed sighting section and a lower section which is received by a slot in the wall of the barrel or shroud. The lower support section preferably has a dovetail shape having opposite slots defined by the dovetail shape. A rod or bar or the like means extends across the slot and engages with one of the slots of the lower support section of the gun sight. A securing means is provided and extends substantially orthogonally to the rod or bar for locking the sight in a fixed position. This securing means is preferably in the form of a set screw passing through a threaded passage in the end of the barrel or shroud wall and engaging with the other slot of the dovetail. The exposed sighting section preferably extends longitudinally over and past the length of the slot in the barrel and thus when the set screw is tightened the gun sight is fixed in position and engages a top flat surface of the barrel.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
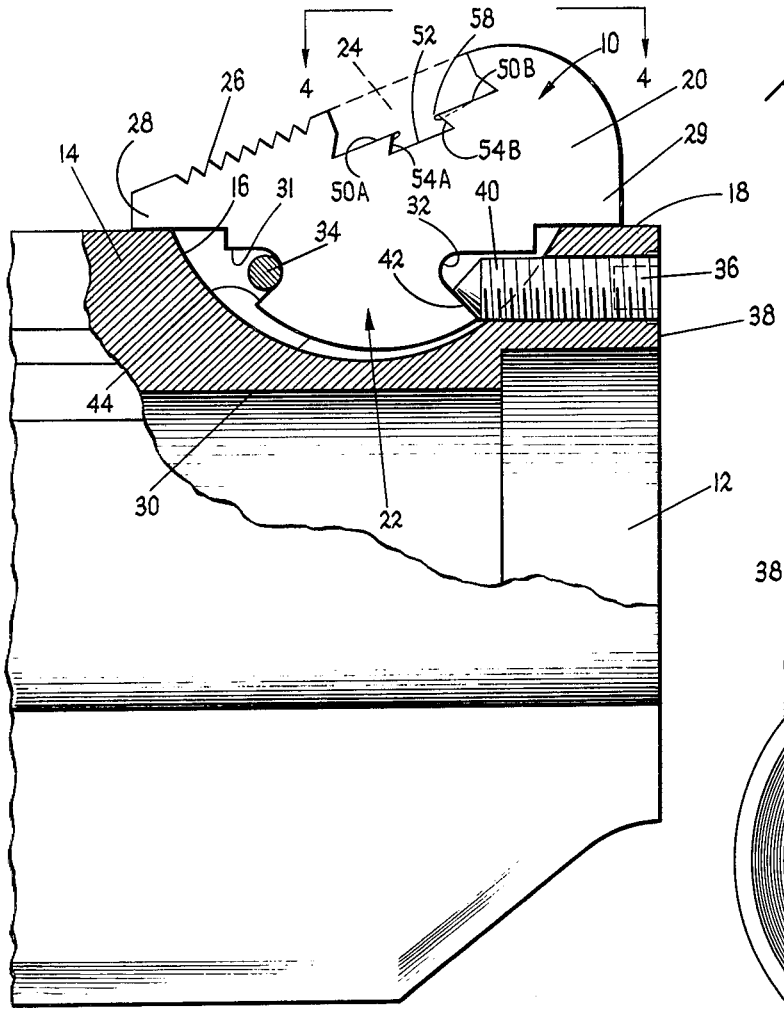
FIG. 1 is a side elevational view partially cross-sectioned showing the gun sight of this invention secured in place at the muzzle end of the barrel of a firearm.

Referring now to the drawings there is shown the gun sight 10 of this invention secured in place at the muzzle end 12 of a firearm such as a pistol or revolver. The drawings show only a fragmentary section of the barrel housing 14. A relatively thin arcuate slot 16 is cut into the barrel housing 14 at the top flat surface 18.

The gun sight 10 includes an exposed sighting section 20 and a lower support section 22. The exposed sighting section 20 receives an insert 24 which may be colored so as to contrast with the rear sight and the object being sighted. This insert is useful for sighting purposes, as is the ridge structure 26. The section 20 has opposite ends 28 and 29 which it is noted overlap the slot 16 and rest upon the flat surface 18 at opposite ends of the slot.

The lower support section 22 is preferably integrally formed with the section 20 and has a bottom surface 30 which defines along with slots 31 and 32 a dovetail shape. A pin or rod 34 is secured in the barrel housing 14 on opposite sides of the slot and extends across the slot normal to the length of the slot 16. FIG. 1 shows the slot 31 in section 22 engaging with the pin or rod 34.

Figure 2:
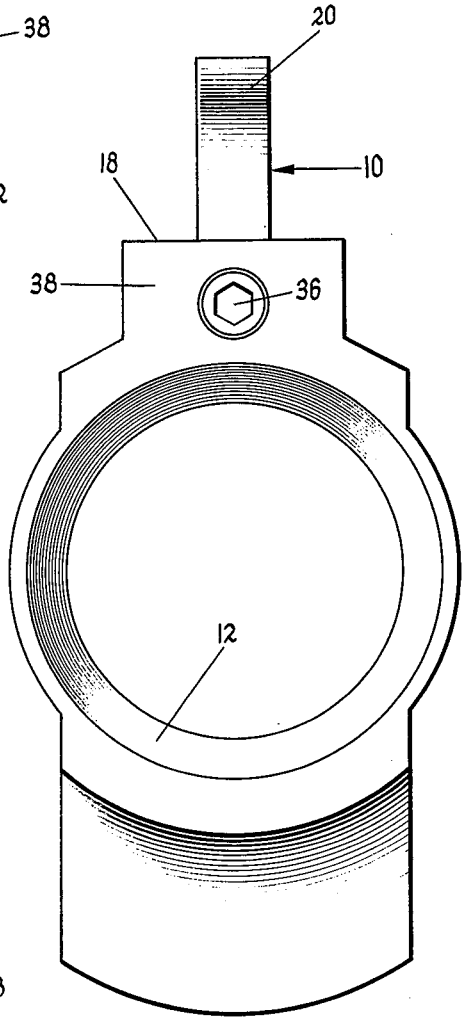
FIG. 2 is a view of the gun sight and muzzle end as viewed looking down the barrel.
Figure 3:
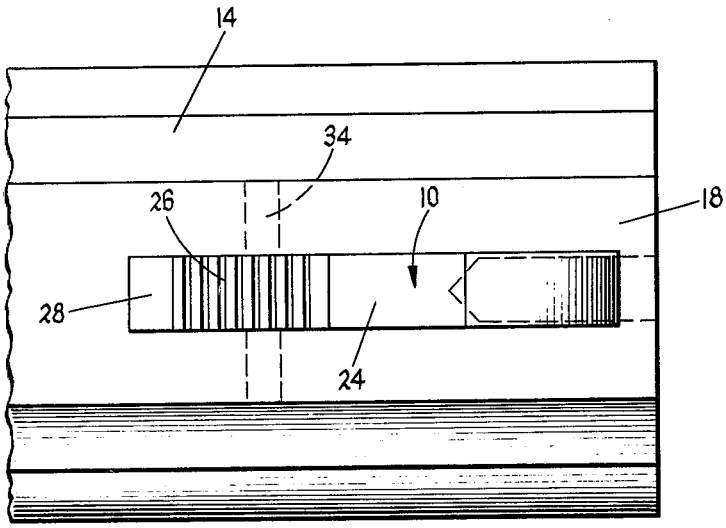
FIG. 3 is a top view of the gun sight shown in FIGS. 1 and 2.

The gun sight 10 is locked in position by means of a set screw 36 which may of the socket head type as indicated in FIG. 2. Obviously, other types of set screws could be used. This set screw shown in FIG. 2 enters the face 38 of the housing 14 and threadedly passes through a passage in the housing having its end 40 contacting the slot 32. The end 40 preferably has a conic shape as shown in FIG. 1 and the slot 32 is defined in part by a straight tapered wall 42. Thus, as the set screw 36 is tightened longitudinal motion of the gun sight is prevented by virtue of engagement of the slot 31 with the pin 34 and further, there is a radial force at the wall 42 which cams the end 29 or the gun sight into intimate contact with a flat surface 18. Also, the tapered wall 44 which is a part of the slot 31 and is in contact with pin 34 experiences a radial force causing the end 28 of the gun sight to tightly contact the flat surface 18 when the set screw 36 is tightened. The gun sight is constructed to have a thickness that fits quite snugly in the slot 16 and thus once the set screw 36 has been tightened the gun sight is in an extremely secured position on the barrel. With this arrangement it is as though the gun sight and barrel were integrally formed. Yet, by releasing the set screw 36 the gun sight can be readily removed and replaced with the same or a different gun sight.

Figure 4:
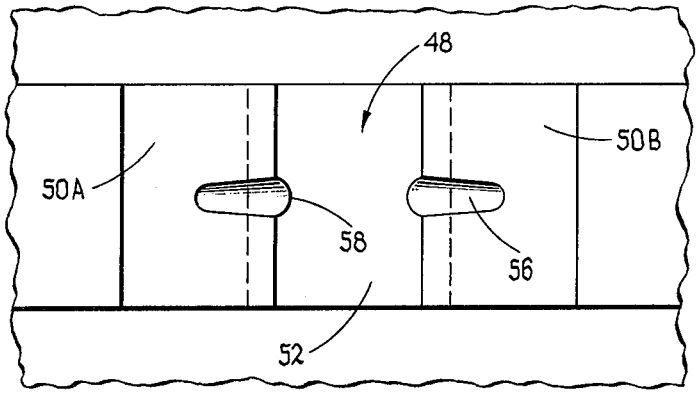
FIG. 4 is a view taken along lines 4—4 of FIG. 1 showing the structure of the cavity for the insert with the insert material removed.

Another feature of the present invention is to provide an insert material that is securely retained in the gun sight. In accordance with the invention means are provided for preventing both longitudinal and transverse displacement of the insert material 24. The material 24 may be injection molded into the cavity 48 in the sighting section 20. FIG. 4 shows the cavity 48 without any insert material therein. FIG. 1 shows a portion of the insert material being removed to expose the construction in the cavity 48.

The cavity 48 is essentially in a doulbe dovetail arrangement having base surfaces 50A and 50B and a bottom surface 52 that is interconnected with the surfaces 50A and 50B by means of slanted surfaces 54A and 54B, respectively. A chisel or punch may be used for making a depression 56 as shown in FIG. 4. By striking this depression (staking) a small flange 58 is formed which essentially extends from the slanted walls 54A and 54B. This protruding flange in combination with the recess 56 locks the insert material once injected against transverse displacement.

Having described one embodiment of the present invention it should now be apparent to those skilled in the art that numerous modifications may be made in this embodiment all of which are contemplated as falling within the scope of this invention. For example, the pin 34 has been shown as a round pin but could just as easily be a square or rectangular bar. Also, as previously mentioned the set screw 36 may be of a different configuration than that which is disclosed.

What is claimed is:

1. In combination, a firearm barrel having a muzzle and a gun sight, means forming an elongated slot in the top of said barrel with elongated sidewalls extending in a direction lengthwise of the barrel from a point spaced from said muzzle, said gun sight having an exposed sighting section and a support section integral therewith, said exposed section extending from said slot, said support section having a dovetail shape with indentations defined by said dovetail extending toward opposite ends of said slot and with opposite walls of said support section engaging said sidewalls to secure said gun sight against lateral movement, means in said slot for engaging said indentation remote from said muzzle to secure said gun sight against movement away from said muzzle, and means defining an opening in said barrel extending from said muzzle to said slot in alignment with said indentation and securing means removably positioned in said opening to secure said gun sight against movement toward said muzzle and to permit disengagement of said gun sight and said barrel upon removal of said securing means from said barrel.

2. A gun sight as set forth in claim 1, wherein said securing means includes a set screw and said opening comprises a threaded passage in said barrel extending from said muzzle to said slot with said set screw threaded therein.

3. A gun sight as set forth in claim 1, wherein said gun sight is elongated with said exposed sighting section longer than the length of said slot with ends of said exposed sighting section engaging the outer surface of said barrel.

4. A gun sight as set forth in claim 2, wherein said set screw has a conical end with said indentation closest to said muzzle defined at least in part by a tapered wall extending into said slot and toward said muzzle, said conical end of said set screw engaging said tapered wall.

5. A gun sight as set forth in claim 4, wherein said exposed sighting section includes an insert of contrasting color to the color of the sighting section and a ridged area adjacent to the insert.

6. A gun sight as set forth in claim 1, wherein said exposed sighting section includes means defining a cavity for an insert of contrasting color to the color of the sighting section and means for preventing both longitudinal and transverse displacement of said insert relative to said cavity.

7. A combination as set forth in claim 1, wherein said means in said slot for engaging the indentation remote from said muzzle comprises a pin spaced from the ends and bottom of said slot extending from one sidewall to the other, and with said indentation remote from said muzzle engaging said pin.

8. A gun sight assembly comprising a gun barrel having a muzzle at one end and a gun sight, said gun sight having an exposed sighting section and a support section received by a slot in said barrel and constructed in a dovetail shape with opposite indentations, means in the slot for engagement with one of said indentations, securing means extending in the direction of said barrel for engagement with the other indentation to lock the sight in fixed position relative to said barrel, said exposed sighting section including means defining a cavity for an insert of contrasting color to the color of the sighting section, and means for preventing both longitudinal and transverse displacement of the insert relative to the cavity, said cavity having a dovetail shape with a lower cavity section in which said insert extends to provide means for preventing longitudinal displacement, and at least one flange for preventing transverse displacement.

9. A gun sight as set forth in claim 8, wherein said cavity is defined by facing edges partially defining the dovetail shape with facing flanges extending from respective edges and formed by punching recesses in the facing edges.

* * * * *